United States Patent [19]

Lau et al.

[11] Patent Number: 4,810,257

[45] Date of Patent: Mar. 7, 1989

[54] MECHANICAL DEWATERING PROCESS

[75] Inventors: Francis S. Lau, Downers Grove; Michael C. Mensinger, Darien; Eugene J. Pyrcioch, Chicago, all of Ill.

[73] Assignee: Institute of Gas Technology, Chicago, Ill.

[21] Appl. No.: 839,119

[22] Filed: Mar. 12, 1986

Related U.S. Application Data

[63] Continuation-in-part of Ser. No. 727,552, Apr. 26, 1985, abandoned.

[51] Int. Cl.[4] ..... C10L 5/00; C10F 7/06

[52] U.S. Cl. ..... 44/27; 44/605

[58] Field of Search ..... 44/1 D, 1 G, 27, 31, 44/33, 32, 605, 589; 210/93

[56] References Cited

U.S. PATENT DOCUMENTS

| | | | |
|---|---|---|---|
| 1,033,779 | 7/1912 | Brune et al. | 44/27 |
| 1,455,728 | 5/1923 | Horst | 44/27 |
| 1,580,058 | 4/1926 | Linker | 44/27 |
| 1,625,058 | 4/1927 | Schroter | 44/27 |
| 1,686,807 | 10/1928 | Ginsbach | 44/27 |
| 4,357,758 | 11/1982 | Lampinen | 44/27 |

FOREIGN PATENT DOCUMENTS

| | | | |
|---|---|---|---|
| 10418 | of 1911 | United Kingdom | 44/32 |

*Primary Examiner*—Carl F. Dees

*Attorney, Agent, or Firm*—Thomas W. Speckman; Ann W. Speckman

[57] ABSTRACT

An improved mechanical dewatering process wherein high moisture content organic carbonaceous materials are mixed with hard, non-porous particulates prior to mechanical dewatering by conventional methods, and the particulates are removed after mechanical dewatering treatment to yield organic carbonaceous product having a moisture content of less than about 50 weight percent total water suitable for use directly as a fuel or as substrate for subsequent conversion processes.

19 Claims, No Drawings

MECHANICAL DEWATERING PROCESS

CROSS-REFERENCE TO RELATED APPLICATION

This application is a continuation-in-part of our copending application, Ser. No. 7,552, filed Apr. 26, 1985 now abandoned.

BACKGROUND OF THE INVENTION

1. Field of the Invention

This invention relates to an improved mechanical dewatering process wherein high moisture content organic carbonaceoss materials such as peat, agricultural and municipal waste, sewage sludge, and biomass, are mixed with additive particulates and then mechanically dewatered to yield organic carbonaceous product having a moisture content of less than about 50 weight percent total water which is suitable for use directly as a fuel, as substrate for subsequent conversion processes, or, in the case of peat, for horticultural purposes.

2. Description of the Prior Art

Abundant, renewable and inexpensive organic carbonaceous raw materials such as agricultural and municipal wastes, sewage sludge, and biomass, and abundant but non-renewable raw materials such as peat, may be dewatered to provide fuel directly and to provide raw material for conversion processes to produce gaseous and liquid energy sources. These organic carbonaceous raw materials, in their naturally occurring states, contain substantial amounts of water. For example, raw peat may comprise greater than 90 weight percent total water. Significant amounts of water must be removed from these raw organic carbonaceous materials before they can be utilized as energy sources. Dewatering techniques known and practiced in the art include mechanical means, thermal drying, and air drying utilizing solar energy.

Solar energy may be utilized to achieve a product moisture content of less than about 50 weight percent when organic carbonaceous material is air dried. Most commercially processed peat is air dried. While this dewatering process is energy efficient, it requires setting aside a large land area for an extended time period, and it is entirely weather dependent. Weather conditions, particularly in the northern regions, are too severe and utilization of solar energy for air drying is not commercially practical.

Mechanical dewatering means, such as roll and belt presses, filter presses, screw presses, and centrifuges, are presently utilized to reduce product moisture content to about 65 to 75 weight percent water. Mechanically dewatered organic carbonaceous material ordinarily must be further thermally dried to achieve the desired product moisture content, usually less than 50 weight percent moisture. Thermal drying is accomplished, typically, by means of a rotary drum, fluidized bed, or flash drier. All of the thermal drying techniques require substantial energy inputs, thereby rendering the technique of mechanical dewatering in combination with thermal drying inefficient and expensive.

Wet carbonization processes are known to the art and are utilized primarily for beneficiation, but wet carbonization also improves the dewaterability of high moisture content organic material. Typically, wet carbonization entails heating the organic carbonaceous material to temperatures between about 300° and 650° F. at pressures between about 300 and 2500 psi, for residence times of about one hour or less. Chemical decarboxylation and dehydration occur during wet carbonization to permit more effective mechanical dewatering, and to enhance the heating value of the dewatered solids. Several wet carbonization processes are reviewed in Mensinger, "Wet Carbonization of Peat: State-of-the-Art Review", *Peat as an Energy Alternative Symposium Papers,* published by Institute of Gas Technology, September 1981, pp. 249–280. All of the systems reviewed in this paper employ water slurry treatments requiring high temperatures and elevated pressures.

Several types of dewatering systems are reviewed and evaluated in Tsaros, "Peat Dewatering, An Overview", paper presented at the IGT symposium *Peat as an Energy Alternative II,* and published by Institute of Gas Technology, June 1982, pp. 199–216. Comparative costs for four different systems utilizing mechanical dewatering in combination with thermal drying to achieve product moisture contents of less than 35 weight percent are presented in Tsaros, "Comparison of Dewatering Costs", paper presented at the IGT symposium *Peat as an Energy Alternative II,* and published by Institute of Gas Technology, June 1982, pp. 253–281.

Significant quantities of municipal sludge and manufacturing by-product wastes are generated yearly in the United States. Appropriate methods for dewatering these wastes for proper disposal vary with the type of waste material and with the ultimate use. For example, wastes disposed by incineration may require a lower moisture content than wastes disposed by landfill.

Product moisture contents of dewatered sludges vary considerably depending upon the dewatering process, the type of sludge, and the type and amount of coagulant or additive used. Drying beds are the most widely used method of municipal sludge dewatering in the United States, and, depending upon the type of sludge, the processing rate required, and the degree of dryness required, this method can produce product moisture contents of 50 to 60 weight percent. Extending the drying period beyond the typical three weeks can reduce the moisture content even further. More than one-half of the municipal sludge produced in the United States is dewatered by drying in this manner.

Despite the low capital cost and low product moisture contents achievable, the use of drying beds for sludge has certain disadvantages: the sludge must be stabilized; more land is required than is required for fully mechanical methods; and the system must be designed with careful concern for climatic conditions. In addition, sludge drying beds are highly visible to the public, they are subject to periodic odors, and the removal of dried sludge is labor-intensive.

The product moisture contents of sludge dewatered by various methods are presented in Table 1, below. These values represent the lowest values reported for dewatered digested primary sludge, waste-activated sludge (WAS), and mixtures of the two, achieved with or without ferric chloride, lime or ash addition. The data show that pressure filtration achieves as low a product moisture content as drying beds (50 to 60 weight percent). However, pressure filtration is an expensive process with higher capital requirements and operating costs than the other methods listed.

TABLE 1

RANGE OF MOISTURE CONTENTS OF DIFFERENT SLUDGES DEWATERED BY VARIOUS METHODS+

| | Dewatered Sludge Type | | |
|---|---|---|---|
| | Digested Primary | WAS* | Digested Primary Plus WAS |
| | wt. percent moisture** | | |
| Gravity Thickening | 88 | 97 to 98 | 92 |
| Belt Pressing | 80 to 84 | 77 to 82 | — |
| Centrifugation | 65 to 72 | 90 to 92 | 70 to 85 |
| Vacuum Filtration | 62 to 65 | 85 | 78 to 86 |
| Pressure Filtration | 60 | 50 to 55 | 50 to 60 |
| Drying Bed (Sand) | | 50 to 60 | |

*Waste Activated Sludge (WAS)
**Lowest moisture achieved is listed
+Ettlich, W. F., et al, Sludge Handling and Conditioning. EPA Report No. EPA 430/9-78-002, February 1978

Addition of coal fines to sewage sludge as a filter aid, coagulant, or deodorant, is known. U.S. Pat. No. 4,159,684 discloses a process wherein coal fines are added to sewage sludge prior to or during dewatering to enhance filtration. Coal fines are consumed in the process, and the chemical properties of the sludge substrate are altered. Fine coal or lignite dust is added to concentrated sewage sludge to coagulate and concentrate solids, thereby enhancing vacuum filtration, in the process taught by U.S. Pat. No. 3,933,634. Again, coal fines are incorporated into the product reducing the weight percentage moisture and improving the calorific value and are consumed as part of the product. U.S. Pat. No. 3,300,403 teaches the addition of powdered coal to sewage sludge as a deodorant, and to enhance the sedimentation of solids. The powdered coal does not significantly reduce the moisture content of the sludge solids, but only that of the mixture due to addition of dry powdered coal which is present in the product, and enhances subsequent combustion.

SUMMARY OF THE INVENTION

It is an object of the present invention to provide a process whereby high moisture content organic carbonaceous feed may be mechanically dewatered to yield an organic carbonaceous product comprising less than about 50 weight percent total moisture.

It is another object of this invention to provide a process for enhancing the mechanical dewaterability of high moisture content organic carbonaceous material by adding hard, non-porous, additive particulates to organic carbonaceous material prior to mechanical dewatering.

It is still another object of this invention to provide a process which recovers and reuses additive particulates to enhance the mechanical dewaterability of high moisture content organic carbonaceous solids.

It is yet another object of this invention to provide an energy efficient and economically attractive process to reduce the total moisture content of organic carbonaceous solids which does not alter the physical or chemical properties of the solids other than to reduce the total moisture content.

The improved-process of the present invention utilizes a hard, non-porous particulate material such as sand or magnetite, as an additive to high moisture content organic materials to enhance mechanical dewatering processes. High moisture content organic carbonaceous materials which have been pretreated according to this invention by addition of suitable particulates may be mechanically dewatered to achieve a product moisture content below about 50 weight percent total water. These low moisture levels are not attainable without further processing using conventional mechanical dewatering processes. The additive particulates may be recovered from the organic carbonaceous materials after mechanical dewatering and may be reused without further treatment. The additive particulates do not react with the organic carbonaceous feed, nor do they alter the chemical or physical properties of the organic carbonaceous product, except for the reduction of moisture content. This improved mechanical dewatering process is energy efficient, and the process may be utilized in conjunction with presently operating mechanical dewatering facilities.

Hard, non-porous, solid additive particulates are added in sufficient quantity to high moisture content organic carbonaceous feed material and thoroughly mixed with the organic material to ensure that the additive particulates are evenly distributed throughout the organic material to be dewatered to achieve the objectives of this invention. High moisture content organic carbonaceous solids mixed with additive particulates of suitable size and quantity are subjected to any suitable mechanical dewatering process. Mechanical dewatering means such as roll and belt presses, filter presses, and screw presses are suitable for use in the process of this invention. Solid additive particulates provide sites for in situ dewatering of organic carbonaceous solids on non-porous surfaces, and provide improved water drainage. Significantly increased quantities of water may be removed by mechanical means due to the distribution of additive particulates throughout the organic carbonaceous material. Mechanical dewatering means known to the art may be adapted to utilize the improved process of this invention and thereby provide enhanced mechanical dewatering.

Water removed from high moisture content organic carbonaceous solids during the mechanical dewatering process may be utilized for productive purposes, such as irrigation, may be returned to the bog in the case of peat dewatering, or may be disposed of as waste. Mechanically dewatered organic carbonaceous product in admixture with additive particulates is conveyed to a separator means wherein dewatered organic carbonaceous product is separated from additive particulates. Solid additive particulates may be recycled, without further processing, and added to raw high moisture content organic carbonaceous feed prior to mechanical dewatering. Mechanically dewatered organic carbonaceous product comprises less than about 50 weight percent total water and is suitable for use directly as fuel or may be utilized in conversion processes to produce gaseous and liquid energy sources and/or chemical feedstocks.

The improved process of this invention provides an energy efficient process which may be utilized instead of thermal drying, which is commonly practiced in combination with mechanical dewatering, and which requires substantial energy inputs to achieve comparable drying effects. This improved process may be utilized with any presently operating fuel dewatering production facilities which utilize mechanical dewatering means. Because it requires no complex equipment, the process of this invention may be conducted at the harvesting or storage site of raw, high moisture content organic materials, and thus reduce transportation and storage costs.

DESCRIPTION OF THE PREFERRED EMBODIMENTS

High moisture content organic carbonaceous materials such as peat, agricultural and municipal waste, sewage sludge, biomass, or mixtures thereof, may be utilized as organic carbonaceous feed in the process of this invention. High moisture content organic carbonaceous materials comprising about 55 to about 98 weight percent total water are especially suited to the process of this invention. Organic carbonaceous feed materials may require preliminary treatment, such as grinding, cutting or chopping, to provide organic carbonaceous feed material of a size suitable for mechanical dewatering. Organic carbonaceous materials, particularly peat and biomass, are preferably prepared by preliminary treatment to achieve feedstock sizes of less than about ¼ inch. High moisture content organic carbonaceous feed is conveyed to a feed preparation vessel after it has undergone preliminary size reduction, if necessary, wherein organic carbonaceous feed is mixed with hard, non-porous, additive particulates. Suitable mechanical mixing means are well known to the art. Any hard, non-porous, additive particulates which are inert to the organic carbonaceous material and water may be used in the process of this invention. The inert solid additive particulates provide sites for in situ dewatering of the organic carbonaceous materials on the hard, non-porous, inert surface of the additive particulates. Suitable additive particulate solids include sand, natural rock, shale, gravel, metallic materials such as iron, steel, bronze, stainless steels, and other metallic elements and alloys, magnetic materials such as magnetite, silicon ferrite, Permalloy (alloys of nickel and iron) Superpermalloy (alloys of nickel, iron and molybdenum), ferroxcube-A ((Manganese, zinc) $Fe_2O_4$), ferrox-cube - B ((Nickel, zinc) $Fe_2O_4$), ceramic materials, plastic materials, and synthetic and polymeric materials such as formaldehyde-phenol condensation products, polyacrylic resins, and the like. Additive particulates having average particle diameters of about 0.04 mm to about 7.0 mm are suitable, and average particle diameters of about 0.25 mm to about 3.0 mm are preferred. Suitable quantities of additive particulates depend upon the type and size of particulate used and the type and size of organic carbonaceous feed used. Additive particulates comprise about 25 to about 90 weight percent, and preferably about 40 to about 60 weight percent, of the total weight of the admixture comprising additive particulate and organic carbonaceous material.

The admixture of additive particulates and organic carbonaceous feed is conveyed for processing in a mechanical dewatering means. Mechanical dewatering means which are known to the art, such as roll and belt presses, filter presses, centrifuges, and screw presses are suitable for use in the process of this invention. The mechanical dewatering means delivers pressure, from about 50 to about 10,000 psi, preferably from about 100 to about 3500 psi, to the additive particulate/organic feed admixture, and may be operated in accordance with conentional residence times, pressures, and other operating conditions. Water separated by the mechanical dewatering device may be collected and returned to the bog in the case of peat dewatering, utilized for irrigation or in other processes, or disposed of as wast.

Dewatered organic carbonaceous material in admixture with additive particulates may be conveyed to a suitable particle separator. A magnetic separator may be utilized when additive particulates comprise a magnetic material, such as magnetite. When sand or other non-magnetic particles are used as additives, those particles may be separated by means well known to the art, such as by fluidized bed separation, air flotation separation, cyclone separation, or gravity separation using vibrating screens. Substantially all additive particulates may be separated from dewatered organic carbonaceous product. Additive particulates may be recycled to the feed preparation vessel for reuse without further treatment.

Dewatered organic carbonaceous product preferably comprises less than about 50 weight percent total water, and may be utilized directly as fuel, may be utilized as raw feed material for conversion processes to produce gaseous or liquid energy sources or, in the case of peat, may be utilized for horticultural purposes.

The following examples set forth specific embodiments in detail and are meant to exemplify the invention and not to limit it in any way.

EXAMPLE I

Minnesota peat having an inherent moisture content of 82.8 percent, was treated according to the process of this invention. 41.14 grams (82.8 weight percent moisture) peat was mixed with 40.18 grams .25 to .30 mm sand particles (20.9 weight percent moisture) in a feed preparation vessel to distribute the sand particles evenly throughout the peat. A laboratory hydraulic press was used to dewater the peat sample mixed with additive particulates. Peat product processed with additive particulates according to the process of this invention, utilizing a dewatering pressure of 3000 psi, had a product total moisture content of 50 weight percent water. Peat processed with additive particulates utilizing a dewatering pressure of 3500 psi, had a product moisture content of 47 weight percent total water.

EXAMPLE II

As a comparison to the test of Example I, 38.01 grams of the same Minnesota peat used in Example I was mechanically dewatered, without the particulates added in Example I, using the laboratory hydraulic press used in Example I. Mechanically dewatered-peat had a product total moisture content of 62 weight percent using a dewatering pressure of 3000 psi and a product total moisture content of 61 weight percent using a dewatering pressure of 3500 psi.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An improved process for mechanically dewatering high moisture content organic carbonaceous materials comprising the steps of:

adding hard, non-porous solid particulates which are inert to said organic carbonaceous materials and water having average particle diameters of from about 0.04 mm to about 7.0 mm to the high moisture content organic carbonaceous feed materials and mixing said particulates with said organic materials evenly distributing said particulates throughout said organic materials and particulates admixture, said particulates comprising about 25 to about 60 weight percent of said admixture;

mechanically dewatering said admixture by a mechanical dewatering emans capable of delivering pressure of at least 50 psi, said solid particulates providing in situ dewatering of said organic carbonaceous materials at sites on surfaces of said non-porous solid particulates;

removing water released from said admixture during dewatering; and separating said particulates from the organic materials to provide a dewatered organic carbonaceous product unaltered in physical and chemical properties from said organic carbonaceous feed material, except for the reduction in moisture content.

2. An improved process according to claim 1 comprising an additional step of:

recirculating said separated particulates for addition to high moisture content organic carbonaceous materials.

3. An improved process according to claim 1, wherein said high moisture content organic carbonaceous materials comprise about 55 to about 98 weight percent total water.

4. An improved process according to claim 3, wherein said high moisture content organic carbonaceous materials are selected from the group consisting of peat, agricultural waste, municipal waste, sewage sludge, biomass, and mixtures thereof.

5. An improved process according to claim 1, wherein said particulates have average particle diameters of about 0.25 mm to about 3.0 mm.

6. An improved process according to claim 1, wherein said particulates comprise about 40 to about 60 weight percent of said admixture.

7. An improved process according to claim 1, wherein said mechanical dewatering means comprises a roll and belt press.

8. An improved process according to claim 1, wherein said mechanical dewatering means comprises a filter press.

9. An improved process according to claim 1, wherein said mechanical dewatering means comprises a screw press.

10. An improved process according to claim 1, wherein said mechanical dewatering means comprises a centrifuge.

11. An improved process according to claim 1, wherein said mechanical dewatering means is capable of delivering pressures to about 10,000 psi.

12. An improved process according to claim 1, wherein said mechanical dewatering means is capable of delivering pressures to about 3,500 psi.

13. An improved process according to claim 1, wherein said hard, non-porous particulates comprise sand.

14. An improved process according to claim 1, wherein said hard, non-porous particulates comprise magnetite.

15. An improved process according to claim 14, wherein said particulates are separated from said organic materials by a magnetic separator means.

16. An improved process according to claim 1, wherein said dewatered organic carbonaceous product comprises less than 50 weight percent total water.

17. An improved process for mechanically dewatering organic carbonaceous materials having a moisture content of about 55 to about 98 weight percent total water, said improvement comprising adding hard, non-porous solid particulates which are inert to said organic carbonaceous materials and water having average particle diameters of from about 0.04 mm to about 7.0 mm to the organic carbonaceous feed materials, forming an admixture thereof having about 25 to about 60 weight percent of said particulates, mechanically dewatering said admixture, said solid particulates providing in situ dewatering of said organic carbonaceous materials on the surfaces of said non-porous solid particulates, and separating said particulates from the organic carbonaceous materials subsequent to application of the mechanical dewatering means to provide a dewatered organic carbonaceous product unaltered in physical and chemical properties from said organic carbonaceous feed material, except for the reduction in moisture content, said dewatered organic carbonaceous product having a moisture content of less than about 50 weight percent total water.

18. An improved process according to claim 17, wherein said hard, non-porous particulates comprise sand.

19. An improved process according to claim 17, wherein said hard, non-porous particulates comprise magnetite.

* * * * *